United States Patent [19]

Pabst et al.

[11] 4,175,616

[45] Nov. 27, 1979

[54] EQUALIZATION TANK FOR COOLING LIQUID

[75] Inventors: Rolf Pabst, Neuhausen; Siegfried Jenz, Illingen, both of Fed. Rep. of Germany

[73] Assignees: Dailmler-Benz Aktiengesellschaft; Suddeutsche Kuhlerfabrik Julius Fr. Behr, both of Fed. Rep. of Germany

[21] Appl. No.: 825,373

[22] Filed: Aug. 17, 1977

Related U.S. Application Data

[62] Division of Ser. No. 601,330, Aug. 1, 1975, Pat. No. 4,064,848.

[30] Foreign Application Priority Data

Aug. 3, 1974 [DE] Fed. Rep. of Germany ..... 2437502

[51] Int. Cl.[2] ..... F28D 15/00; F01P 3/22

[52] U.S. Cl. ..... 165/107 D; 123/41.54; 123/41.51; 55/193; 55/309

[58] Field of Search ..... 123/41.54, 41.51; 55/193, 309, 159; 165/107 D

[56] References Cited

U.S. PATENT DOCUMENTS

| | | | |
|---|---|---|---|
| 3,282,333 | 11/1966 | Jensen | 55/159 |
| 3,576,181 | 4/1971 | Neal | 123/41.51 |

*Primary Examiner*—Charles J. Myhre
*Assistant Examiner*—M. Moy
*Attorney, Agent, or Firm*—Craig and Antonelli

[57] ABSTRACT

An equalization tank for a cooling liquid which is subdivided by an essentially perpendicularly disposed interior partition wall into a prechamber and into a suction-discharge chamber; the vent lines which are connected with the cooling water outlet of the cooling water jacket of the engine and with the heat-exchanger thereby terminate in the prechamber whereas the auxiliary return line leading to the circulation pump for the cooling liquid terminates in the suction-discharge chamber; the partition wall is thereby also provided with a connection located near the tank bottom for cooling liquid, low in air or gas bubbles, as also with a vent connection between the prechamber and the suction-discharge chamber which is located near the tank ceiling.

7 Claims, 4 Drawing Figures

FIG. 1
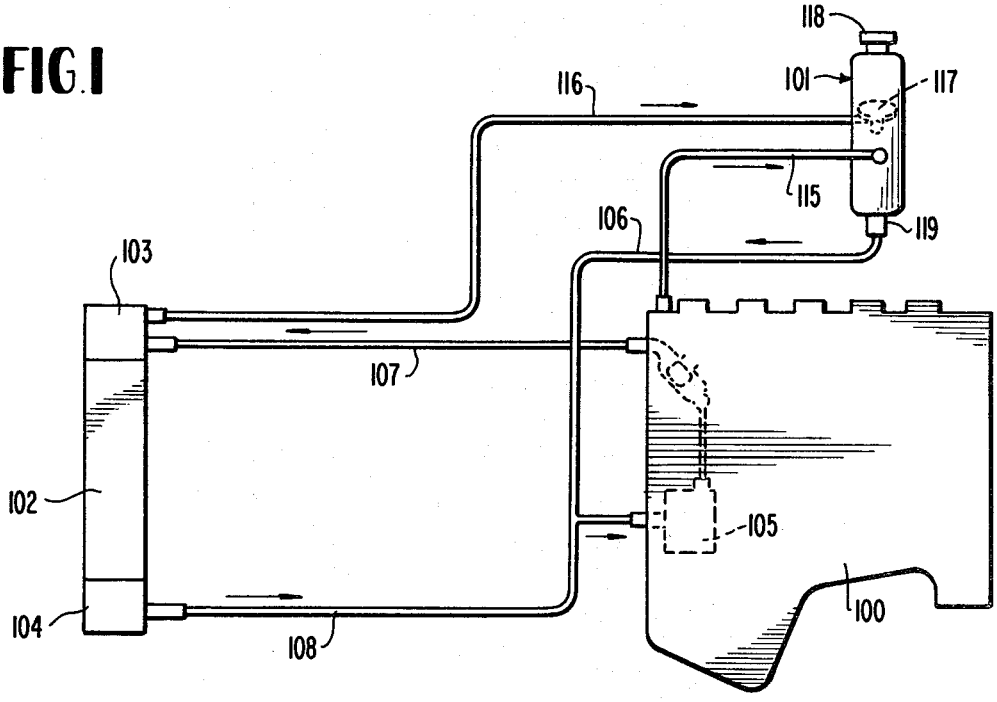
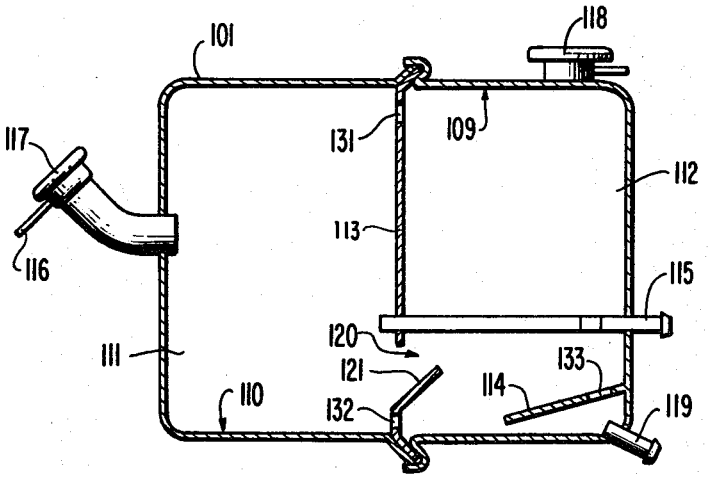
FIG. 2
FIG. 4
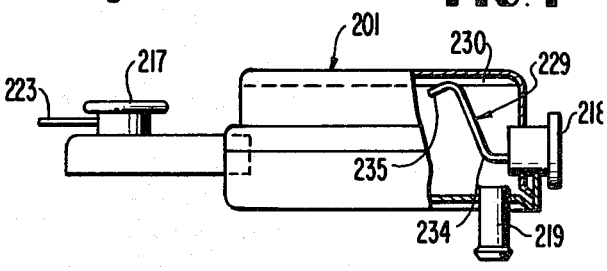
FIG. 3
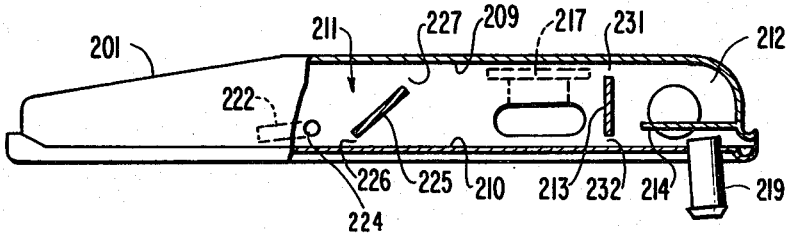

EQUALIZATION TANK FOR COOLING LIQUID

This is a division of application Ser. No. 601,330, filed Aug. 1, 1975, now U.S. Pat. No. 4,064,848.

The present invention relates to an equalization vessel or tank for a cooling liquid, which is connected on its inlet side by way of at least two vent lines and on its discharge side by way of an auxiliary return flow line with a main circulatory system for the cooling water, connecting both the cooling liquid inlet as also the cooling liquid outlet of a cooling liquid jacket of an internal combustion engine with a heat-exchanger for the heat transfer, in such a manner that one vent line as engine operational vent line is operatively connected continuously with the cooling water outlet of the cooling liquid jacket while the other vent line is operatively connected with the heat-exchanger and the auxiliary return flow line is continuously connected with the cooling water inlet.

Equalization tanks of this type are known in the art (German Auslegeschrift No. 2,058,995) and entail the advantage that also with a closed thermostat valve—i.e., when the heat-exchanger is disconnected from the engine operational vent line—both the operational venting as also the fill-in venting of the heat-exchanger are assured by way of the equalization tank by means of the vent line connected with the heat-exchanger.

The present invention is concerned essentially with the task to further improve such equalization tanks in order to assure also with low liquid levels in the tank an effective air- and gas-separation out of the cooling liquid.

The underlying problems are solved according to the present invention in that an essentially vertically disposed inner partition wall forms a subdivision into a prechamber or first separation chamber and into a suctioning-off chamber or second separation chamber, in that the vent lines terminate in the prechamber and the auxiliary return flow line in the suctioning-off chamber, and in that the partition wall is provided with a connection for cooling liquid low in bubbles which is disposed at the tank bottom as also with a vent connection disposed at the tank ceiling between prechamber and suctioning-off chamber.

In the equalization tank according to the present invention, two venting chambers are created by the partition wall which are connected with each other at the tank bottom in order to feed the cooling liquid layer which is low in gas bubbles or free of gas bubbles, to the orifice of the auxiliary return flow line customarily located at the tank bottom, whereas the vent particles collect in both chambers in an air chamber space at the tank ceiling and the vent connection of the partition wall establishes a pressure equalization between the upper air- or gas-bubbles of both chambers. It is far-reachingly avoided in this manner that the auxiliary return flow line is able to suck in air or gas with a low cooling liquid level.

In order to avoid an excessive throttling in the equalization tank by means of the partition wall during larger cooling liquid quantities per unit time and in order to permit nonetheless exclusively cooling liquid low in gas bubbles or free of gas bubbles to pass through the connection located at the tank bottom, it is additionally proposed according to the present invention that the partition wall is provided with a third connection for cooling liquid enriched with gas bubbles between the prechamber and the suctioning-off chamber, which is located geodetically between the vent connection and the connection for the cooling liquid low in bubbles. It is thereby advantageous if the orifice of the third connection which terminates in the suctioning-off chamber is equipped with and shielded by means of an obliquely upwardly inclined sheet-metal guide baffle member in order to direct the flow in the direction toward the tank ceiling so that the air- or gas-bubbles which are still enclosed, are separated with certainty at the latest in the suctioning-off chamber.

The known equalization tank includes a short fill-in pipe connection for cooling liquid, to which is connected the vent line connected with the heat-exchanger. In the application of the present invention to this known equalization tank, provision is made that the short fill-in pipe connection terminates in the prechamber.

It is additionally customary in equalization tanks for cooling liquid to provide a pressure equalization valve between the tank interior space and the atmosphere. In application of the present invention to an equalization tank with a pressure equalization valve, it is proposed that the pressure equalization valve is connected with the suctioning-off chamber. It is avoided by the partition wall in the equalization tank according to the present invention that cooling liquid can be discharged by way of the pressure equalization valve owing to an excess pressure in the tank interior space since a calm liquid level will always establish itself in the suctioning-off chamber and the valve is customarily in operative connection with a place near the container ceiling.

In order to avoid in case of a larger yield of air- or gas-particles that non-separated particles can enter into the auxiliary return flow line, it is additionally proposed that a sheet-metal shielding member is arranged above the opening of the auxiliary return flow line terminating in the suctioning-off chamber.

In a further advantageous embodiment of the equalization tank according to the present invention, the arrangement may be made in such a manner that the sheet-metal shielding member is inclined to the horizontal plane and is provided in its upper part with a vent connection between the section of the suctioning-off chamber located on its lower side and the section of the suctioning-off chamber located on its upper side. With such an equalization tank according to the present invention, the lower portion of the sheet-metal shielding member may be located very close to the tank bottom in order to permit with certainty that only cooling liquid low in bubbles or free of bubbles is able to enter into the auxiliary flow return line. On the other hand, it is avoided by the vent line connection that an air pocket can form underneath the sheet-metal shielding member.

Especially in those cases in which only a slight structural height is available for the equalization tank, it is advantageous if additional guide or deflection means are arranged in the prechamber and are interposed from a flow point of view in such a manner between the opening of the one vent line terminating in the prechamber and the connections of the partition wall that the cooling liquid, enriched with bubbles, of this vent line is conducted in the direction toward the tank ceiling. It is achieved in this manner that a large portion of the air- or gas-bubbles are separated out of the cooling liquid already prior to flowing through the partition wall so that the cross section of the connection in the partition wall which is located at the tank bottom, can be constructed relatively large and a third connection in the partition wall can be dispensed with. In order to also conduct the flow layer low or free of bubbles at the bank bottom to the auxiliary return flow line without significant deflections and the like, when the liquid levels in the equalization tank are low, it is additionally advantageous if the additional guide means is provided with a connection disposed at the tank bottom for cooling liquid low in air- or gas-bubbles between the orifice of the one vent line disposed upstream and the connections of the partition wall.

Accordingly, it is an object of the present invention to provide an equalization tank for cooling liquid which avoids by simple means the aforementioned shortcomings and drawbacks encountered in the prior art.

Another object of the present invention resides in an equalization tank for the cooling liquid of an internal combustion engine which assures an effective air- and gas-separation out of the cooling liquid even at low liquid levels in the tank.

A further object of the present invention resides in an equalization tank of the type described above in which the particles to be vented collect at the tank ceiling and a pressure equalization is established between the air- or gas-bubbles in the upper portion of the tank.

Still a further object of the present invention resides in an equalization tank for internal combustion engines in which a sucking-in of air or gas into the auxiliary return flow line is precluded also at low liquid levels.

Still another object of the present invention resides in an equalization tank of the type described above which avoids unnecessary throttling in the various connections thereof while at the same time far-reachingly avoiding the admission of non-separated air- or gas-particles into the auxiliary return flow line.

Another object of the present invention resides in an equalization tank for internal combustion engines subdivided into two chambers by a partition wall, in which the two chambers are interconnected in such a manner that the separation of gas and air bubbles is optimally favored.

A further object of the present invention resides in an equalization tank of the type described above which can be readily installed also in case of constricted space conditions for the tank.

These and other objects, features and advantages of the present invention will become more apparent from the following description when taken in connection with the accompanying drawing which shows, for purposes of illustration only, two embodiments in accordance with the present invention, and wherein:

FIG. 1 is a schematic view of a cooling liquid circulatory system of an internal combustion engine equipped with an equalization tank in accordance with the present invention;

FIG. 2 is an elevational view, partly in cross section and on an enlarged scale, of a first embodiment of the equalization tank of the present invention according to FIG. 1;

FIG. 3 is a side elevational view, partly in cross section, of a second embodiment of an equalization tank in accordance with the present invention; and FIG. 4 is an end elevational view, partly in cross section, of the equalization tank of FIG. 3.

Referring now to the drawing wherein like reference numerals are used throughout the various views to designate like parts, and more particularly to FIG. 1, the arrangement of an equalization tank generally designated by reference numeral 101 of the present invention can be seen from the cooling liquid circulatory system of an internal combustion engine 100, schematically illustrated in this Figure. A cooling liquid jacket of the internal combustion engine 100 is connected by way of an inlet line 107 with a heat-exchanger or radiator 102, whereby the inlet line 107 terminates in an upper common collecting box 103. A main flow return line 108 leads from a lower common collecting box 104 of the heat-exchanger 102 to a pump 105. An engine operational vent line 115 leads from the cooling liquid jacket of the internal combustion engine 100 to the equalization tank 101. Furthermore, a vent line 116 leads from the upper common collecting box 103 of the heat-exchange 102 to the equalization tank 101. The two vent lines 115 and 116 have to be correspondingly matched to the pressure conditions. This may take place by means of throttles or the like which are installed into the vent lines.

The equalization tank 101 includes a short fill-in pipe connection 117, a pressure equalization valve 118 and a short suction pipe connection 119 for an auxiliary return line 106 leading to the pump 105.

In FIG. 2, the equalization tank 101 of the present invention is schematically illustrated, partly in cross section. The equalization tank 101 is subdivided by a partition wall generally designated by reference numeral 113 into two chambers, namely, a prechamber or first separation chamber 111 and a suctioning-off chamber or second separation chamber 112. The partition wall 113 is disposed essentially vertically. The vent line 116 from the heat-exchanger 102 leads to the fill-in pipe connection 117. The so-called engine operational vent line 115 of the internal combustion engine 100 and the vent line 116 lead into the prechamber 111. The vent line 115 thereby traverses the suctioning-off chamber 112 and the partition wall 113 within the lower area thereof.

A portion of the air separates immediately out of the liquid-air mixture in the prechamber 111. An air chamber space is arranged at the tank ceiling above chambers 111 and 112. In the suctioning-off chamber 112, the cooling liquid free of air is then to be sucked off by the pump 105 by way of the pipe stud 119 and the auxiliary return line 106. In order to achieve a pressure and liquid level equalization, upper bores 131 and lower bores 132 are advantageously provided in the vertically disposed partition wall 113 at or near the tank ceiling 109 and the tank bottom 110, respectively. Geodetically between the bores 131 located at the tank or near the tank ceiling and the bores 132 located at or near the tank bottom 110, the partition wall 113 is additionally provided with a third connection generally designated by reference numeral 120 for the passage of cooling liquid enriched with air- or gas-bubbles. The opening of the connection 120 disposed in the suctioning-off chamber 112 is shielded by a sheet-metal guide member 121. It is achieved by this arrangement that only cooling liquid free of bubbles can reach from the bottom 110 into the line 106 and the gas bubbles which are still present in the flow quantity of the third connection 120, are deflected upwardly, are separated at the top of the tank and are able to collect in the air pocket underneath the ceiling 109.

As can be seen from FIG. 2, the vent line 116 from the heat-exchanger 102 terminates in a short fill-in pipe connection 117.

A sheet-metal shield member 114 is advantageously arranged above the opening of the short suction pipe connection 119, which terminates in the interior space of the tank. The sheet-metal member 114 is so constructed and dimensioned that only liquid from the bottom 110 of the suctioning-off chamber 112 can be sucked off. A vent bore 133 is advantageously provided at the upper portion of the inclined sheet metal shield member 114 in order to prevent the formation of an air pocket.

The equalization tank generally designated by reference numeral 201 according to the present invention, illustrated in FIGS. 3 and 4, involves a construction especially suited for constricted conditions in a motor vehicle. The equalization tank 201 can be mounted directly on the heat-exchanger 102 of FIG. 1. As to the rest, the same requirements are made of this tank 201 as are made of the separately arranged tank 101 of FIG. 2.

The equalization tank 201 is also subdivided by means of a partition wall 213 into two chambers, namely, into a prechamber or first separation chamber 211 and into a suctioning-off chamber or second separation chamber 212.

Whereas the suctioning-off chamber 212 is provided with a short suction pipe connection 219 terminating at the tank bottom 210 for the connection of the auxiliary return flow line 106 (FIG. 1), both a short fill-in pipe connection 217 for cooling liquid as also a short pipe connection 222 (FIG. 3) for the connection of the vent line 115 of the internal combustion engine 100 (FIG. 1) terminate in the prechamber 211. The fill-in pipe connection 217 is additionally provided with a line connection 223 for the connection of the vent line 116 of the heat-exchanger 102 (FIG. 1).

The partition wall 213 is correspondingly provided with a connection 232 located at or near the tank bottom 210 for cooling liquid low in air- or gas-bubbles and with a vent connection 231 located at or near the tank ceiling 209. A horizontally disposed sheet-metal shield member 214 is arranged near the tank bottom 210 above the opening of the short suction pipe connection 219 which terminates in the suctioning-off chamber 212.

A sheet-metal guide member 225 which is disposed at an inclination to the horizontal plane is effectively interconnected between the connections 231 and 232 of the partition wall 213, on the one hand, and the opening 224 of the line connection 222 terminating in the prechamber 211, on the other hand; the sheet metal guide member 225 guides or directs the flow discharged out of the engine operational vent line 115 into the prechamber 211 in the direction toward the tank ceiling 209 and is provided with a connection 226 located at or near the tank bottom 210 for the passage of cooling liquid low or free in bubbles. It is achieved by this arrangement that the opening 224—through which flows in the larger portion of the through-flow quantity per unit time of the equalization tank—has a large spacing with respect to the suction pipe connection 219 and with respect to the suctioning-off chamber 212 while the associated flow particles of this opening 224 are deflected several times and as a result thereof air or gas particles enclosed therein are effectively separated out. A free flow cross section 227 of the sheet-metal guide member 225 is provided at the height of the tank ceiling 209 and brings about that the throttling effect of the sheet metal guide member 225 is not excessive and the gas- and air-particles are absorbed with certainty by the gas or air pocket 230 (FIG. 4) in contact with the tank ceiling wall 209.

A pressure equalization valve 218 is interconnected between the interior space of the suctioning-off chamber 212 and the atmosphere whose valve connection on the chamber side is connected with the longer leg 234 of a U-shaped pipe generally designated by reference numeral 229. The orifice of the shorter leg 235 of the U-shaped pipe 229 which is located near the tank ceiling 209 assures the presence of a continuous air pocket.

It is particularly advantageous to construct the equalization tank according to the present invention either completely or partly of synthetic plastic material of any suitable type, such as synthetic resinous material. Considerable savings in weight and cost are achieved thereby and the manufacture is considerably simplified.

While we have shown and described only two embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. An equalization tank for volume equalization and air separation of a liquid heat carrier flowing through a circulating system, especially for a circulatory system for combustion engine cooling spaces and the like, comprising:

separation chamber means, air chamber space means arranged above said separation chamber means, venting means communicating the air chamber space means and the separation chamber means for accommodating escape of entrapped air from the liquid flowing through the separation chamber means to the air chamber space means, the separation chamber means being constructed and arranged to form liquid-air separating means and including a plurality of separate separation chambers with partition means therebetween, a first of the separation chambers including an inlet portion coupled with a separation flow entrance leading from the circulating system and an outlet portion in said partition means coupled directly with a second of the separation chambers, the outlet portion being constructed of a lower connection near the tank bottom for permitting cooling liquid low in gas bubbles to flow therethrough from the first separation chamber to the second separation chamber, and an upper vent connection near the tank top, and guide means arranged in a central zone of the first separation chamber and spaced between an opening of the inlet portion and the partition means for guiding cooling liquid enriched in bubbles in the direction toward the tank ceiling and said upper vent connection, and away from said lower connection.

2. An equalization tank according to claim 1, wherein a connecting means is located near the tank bottom for conducting liquid low in bubbles between the inlet portion and the outlet portion facing sides of said guide means.

3. An equalization tank according to claim 2, in which the equalization tank is adapted to be connected with a main circulatory system for the cooling water of an internal combustion engine connecting the cooling water inlet as also the cooling water outlet of a cooling water jacket of an internal combustion engine with a heat-exchanger means in such a manner that a vent line coupled with the opening of the inlet portion separated by the guide means from the outlet portion is continuously in communication as an engine operational vent line with the cooling water outlet of the cooling water jacket whereas another vent line coupled with a portion of the first separation chamber between the guide means and the outlet portion is in communication with the heat-exchanger means, and the second separation chamber is in continuous communication with the cooling water inlet of the cooling water jacket.

4. An equalization tank for volume equalization and air separation of a liquid heat carrier flowing through a circulating system, especially for a circulatory system for combustin engine cooling spaces and the like, comprising:

separation chamber means, air chamber space means arranged above said separation chamber means, venting means communicating the air chamber space means and the separation chamber means for accommodating escape of entrapped air from the liquid flowing through the separation chamber means, the separation chamber means being constructed and arranged to form liquid-air separating means and including a plurality of separate separation chambers, a first of the separation chambers including an inlet portion coupled with a separation flow entrance leading from the circulating system and an outlet portion coupled directly with a second of the separation chambers, the outlet portion being constructed and arranged to permit passage therethrough of at least a substantial portion of the flow of liquid through the first separation chamber to the second separation chamber, and guide means arranged in the first separation chamber and interposed from a flow point of view between an opening of the inlet portion terminating in the first separation chamber and the outlet portion for guiding liquid enriched in bubbles of the opening of the inlet portion in the direction toward the tank ceiling, wherein a portion of the first separation chamber between the guide means and the outlet portion is provided with an additional inlet portion coupled with a separate separation flow entrance leading from the circulatory system.

5. An equalization tank according to claim 4, wherein a fill-in pipe connection terminates in the portion of the first separation chamber between the guide means and the outlet portion.

6. An equalization tank according to claim 5, wherein the fill-in pipe connection is provided with connection means to couple the separate separation flow entrance with the circulatory system.

7. An equalization tank according to claim 5, wherein the separate separation flow entrance is in communication with the heat-exchanger means of the circulatory system.

* * * * *